US005168310A

United States Patent [19]

Hayashi et al.

[11] Patent Number: 5,168,310

[45] Date of Patent: Dec. 1, 1992

[54] ORIGINAL IMAGE TRANSPORTING AND READING APPARATUS

[75] Inventors: Tatsushi Hayashi; Kozo Takahashi, both of Nara, Japan

[73] Assignee: Sharp Kabushiki Kaisha, Osaka, Japan

[21] Appl. No.: 626,044

[22] Filed: Dec. 11, 1990

[30] Foreign Application Priority Data

Dec. 15, 1989 [JP] Japan ..... 1-326537
Mar. 19, 1990 [JP] Japan ..... 2-71676
Mar. 27, 1990 [JP] Japan ..... 2-80075

[51] Int. Cl.[5] ..... G03G 15/00; G03G 15/04

[52] U.S. Cl. ..... 355/233; 355/50; 358/496

[58] Field of Search ..... 355/232, 233, 309, 48–51, 355/75; 358/496

[56] References Cited

U.S. PATENT DOCUMENTS 3,806,239 4/1974 Inoue et al. ..... 355/50 X
4,259,711 3/1981 Mochizuki ..... 355/49 X
4,380,389 4/1983 Kingsley ..... 355/50
4,429,866 2/1984 Castro-Hahn ..... 355/309 X
4,933,722 6/1990 Fujiwara ..... 355/233
4,970,606 11/1990 Shima ..... 358/496 X

*Primary Examiner*—Joan H. Pendegrass
*Attorney, Agent, or Firm*—David G. Conlin; Robert F. O'Connell

[57] ABSTRACT

An image reading apparatus is provided with a transparent plate horizontally disposed on which an image reading operation is performed, and a transporting device disposed above the transparent plate for transporting an original sheet to the transparent plate. The transporting device includes a pressure roller for pressing the original sheet onto an upper surface of the transparent plate at a pressure applying position and transporting the original sheet along the upper surface of the transparent plate. The image reading apparatus is also provided with a light source disposed below the transparent plate for illuminating through the transparent plate a portion of the transported original sheet. The illuminated portion of the original sheet is positioned on the upper surface of the transparent plate at an upstream side of the pressure applying position with respect to a transporting direction of the original sheet. The image reading apparatus is further provided with a detecting device for detecting through the transparent plate a reflection light from the illuminated portion of the original sheet.

10 Claims, 6 Drawing Sheets

ORIGINAL IMAGE TRANSPORTING AND READING APPARATUS

BACKGROUND OF THE INVENTION

1. Field of the Invention

The present invention relates to an image reading apparatus, and more particularly, an original transporting and reading apparatus, which is used, for example, in a copying apparatus, and which includes a device for transporting an original sheet to an image reading position at a transparent plate where a light exposure type image reading operation is performed.

2. Description of the Related Art

As one of various kinds of image reading apparatuses, there is an image reading apparatus, which includes a device for automatically transporting an original sheet to an image reading position of the image reading apparatus.

Compared with other types of the image reading apparatuses to which the original sheet is manually feeded or placed, the image reading apparatus with such an automatic transporting device is advantageous in its easy and speedy operation.

Such a kind of transporting device is provided on the upper side of a main body of the image reading apparatus and includes a plurality of rollers and paper guides to transport the original sheet from an original hopper thereof to the image reading position.

The main body includes the transparent plate at one portion of its upper surface, which is made of glass etc. This transparent plate offers the image reading position of the image reading apparatus.

The transporting device includes a pressure roller for pressing the original sheet onto the transparent plate at the pressure applying position. The pressure roller is made of material of high friction coefficient at its surface so as to effectively transport the original sheet through the transparent plate. Thus, a good contact between the original sheet and the transparent plate is achieved at this pressure applying position during the transportion of the original sheet along the transparent plate.

In case that the image reading apparatus is used in the copying apparatus, the image reading apparatus, for example, performs a slit-exposure process by illuminating a light onto the original sheet through the transparent plate, and by detecting a slitted light out of the reflection light from the original sheet through the transparent plate and a slit. The slitted light is guided onto the photo-sensitive drum so as to form an latent image.

Thus, at each slit-exposure process, a slitted recutangular image of the original sheet, which has a predetermined width and length, is formed on the photo sentitive drum, in such a manner that the longitudinal axis of the slitted light is positioned on the pressure applying position and parallel to the wide direction of the original sheet. This slit-exposure process is repeated as the original sheet is transported, resulting in forming all the image of the original sheet onto the photo-sensitive drum.

Then, a toner image is formed on the photo-sensitive drum, and the toner image is transferred onto the recording sheet to output the image copied recording sheet.

In the above mentioned transporting device, taking a view of spatial arrangement, the original sheet is transported to the transparent plate from the upper side off to the right or left of the pressure roller, then illuminated by the light on the transparent plate at the pressure applying position of the pressure roller, and then transported toward the upper side off to the left or right of the pressure roller, back to the original hopper.

In the above mentioned transporting device, when the original sheet is transported from the pressure roller to the next transporting roller which is positioned above the pressure roller off to the left or right, the original sheet is pushed from the behind by the pressure roller and transported obliquely and upwardly into a curved transporting path. Thus, because of the stiffness and elasticity of the original sheet, the original sheet gradually separates from the surface of the transparent plate right after passing through the pressure applying position of the pressure roller.

In other word, at a downstream side, with respect to the transporting direction, of the pressure applying position, the original sheet does not have a good contact with the transparent plate, instead, an undesirable phenomenon called "floating" of the original sheet occurs due to its stiffness and elasticity.

On the contrary, at the upstream side of the pressure roller, the original sheet is transported to the pressure roller by the previous transporting roller which is positioned above the pressure roller off to the right or left, so that the original sheet is pushed from the behind by this transporting roller and transported obliquely and downwardly from a curved transporting path. Thus, the original sheet presses itself onto the transparent plate by its rigidity and elasticity in the vicinity of the pressure roller at this upstream side.

Accordingly as described above, the original sheet has a good contact with the transparent plate at the upstream side of the pressure applying position for a ceratin length. However, if the rigidity of the original sheet is very high, for example in a case of a very thick paper is used as the original sheet, this contacting length may become very short.

Consequently, in the above mentioned image reading apparatus in which the center of the slitted light having a certain slit width along the transporting direction is set on the pressure applying position, all portion of the slitted light can not be well focused, since the optical distance to the photo-sensitive drum from one portion of the illuminated original sheet contacting the transparent plate is different from that of other floating portion of the illuminated original sheet. Namely, about a half portion of the illuminated original sheet at the downstream side of the pressure applying position can not be image-read with a well focused condition.

Thus, there is a first problem that this off-focus degrades the quality of the image obtained by the image reading apparatus.

By the way, the above mentioned kind of image reading apparatus may suffer from the phenomenon called "off-center" of the original sheet, which means the original sheet is not properly positioned in the center of the transporting path at the pressure roller. When this off-center occurs, the dark shadow image would be formed in the edge portion of the recording sheet without any countermeasure.

Accordingly, a blanking lamp is equipped for blanking this shadow image, with the drawback that a certain amount of the image loss with respect to the edge portion of the original sheet is innevitablly caused, which is the second problem.

In the above mentioned image reading apparatus, various sizes of the original sheet can be transported. Thus, all the rollers including the pressure roller have larger width than the prescribed maximum width of the original sheet to be transported.

So, when an original sheet which has a smaller width than this maximum width is transported to the transparent plate, the pressure roller gets a direct contact with the transparent plate at one or both edges of the original sheet. Here, since the pressure roller has the high friction coefficient as aforementioned, when this pressure roller rotates with such a condition of contacting the transparent plate, the driving resistance is greatly increased.

Accordingly, a large torque is required to rotate the pressure roller, where a large proportion of the driving force for the pressure roller is consumed against this frictional force, with a drawback of making it very difficult to transport the original sheet smoothly. Namely, in this configuration, each time the pressure roller is slipped on the transparent plate, the transporting speed of the original sheet is varied, making the movement of the original sheet clumsy, though it is supposed to be constant to perform a proper slit-exposure process.

Consequently, the expansion and shrinkage of the image obtained by the image reading apparatus is caused in the direction corresponding to the transporting direction of the original sheet, which is the third problem.

SUMMARY OF THE INVENTION

It is therefore a first object of the present invention to provide an image reading apparatus, which can prevent the off-focus due to the floating of the transported original sheet during the image reading operation, and thus improve the quality of the image read from the transported original sheet.

It is a second object of the present invention to provide an image reading apparatus, which can prevent the off-focus due to the floating of the transported original sheet during the image reading operation, thus improve the quality of the image read from the transported original sheet, and in which the shadow image due to the off-center of the transported original sheet is avoided with little of the image loss.

It is a third object of the present invention to provide an image reading apparatus, in which the original sheet can be smoothly transported through the image reading position regardless of the size of the original sheet, and thus which can improve the quality of the image read from the transported original sheet.

According to the present invention, the first object can be achieved by a first image reading apparatus which is provided with a transparent plate horizontally disposed on which an image reading operation is performed, and a transporting device disposed above the transparent plate for transporting an original sheet to the transparent plate. The transporting device includes a pressure roller for pressing the original sheet onto an upper surface of the transparent plate at a pressure applying position and transporting the original sheet along the upper surface of the transparent plate. The first image reading apparatus is also provided with a light source disposed below the transparent plate for illuminating through the transparent plate a portion of the transported original sheet. The illuminated portion of the original sheet is positioned on the upper surface of the transparent plate at an upstream side of the pressure applying position with respect to a transporting direction of the original sheet. The first image reading apparatus is further provided with a detecting device disposed below the transparent plate for detecting through the transparent plate a reflection light from the illuminated portion of the original sheet.

According to the present invention, the second object can be achieved by a second image reading apparatus which is provided with a transparent plate horizontally disposed on which an image reading operation is performed, and a transporting device disposed above the transparent plate for transporting an original sheet to the transparent plate. The transporting device includes a pressure roller for pressing the original sheet onto an upper surface of the transparent plate at a pressure applying position and transporting the original sheet along the upper surface of the transparent plate. The second image reading apparatus is also provided with a paper guide having a plate portion which is disposed parallel to the transparent plate with a small gap therebetween in the vicinity of the pressure roller and which surface facing to the upper surface of the transparent plate consists of a reflecting surface. The original sheet is transported along the transparent plate in the small gap. The second image reading apparatus is further provided with a light source disposed below the transparent plate for illuminating through the transparent plate a portion of the transported original sheet on the transparent plate, and a detecting device disposed below the transparent plate for detecting through the transparent plate a reflection light from the illuminated portion of the original sheet.

According to the present invention, the third object can be achieved by a third image reading apparatus which is provided with a transparent plate horizontally disposed on which an image reading operation is performed, and a transporting device disposed above the transparent plate for transporting an original sheet to the transparent plate. The transparent device includes a pressure roller for pressing the original sheet onto an upper surface of the transparent plate at a pressure applying position and transporting the original sheet along the upper surface of the transparent plate. The third image reading apparatus is also provided with a light source disposed below the transparent plate for illuminating through the transparent plate a portion of the transported original sheet on the transparent plate, and a detecting device disposed below the transparent plate for detecting through the transparent plate a reflection light from the illuminated portion of the original sheet. The pressure roller includes a roller portion, which presses the original sheet and which has a width smaller than a predetermined smallest width of the original sheet, and at least one inclined portion, which is coaxially connected to an end of the roller portion at one end thereof having a same diameter as the roller portion and which diameter gradually decreases from one end toward the other end.

In the first image reading apparatus, the transporting device transports the original sheet to the transparent plate. The pressure roller of the transporting device presses the original sheet at the pressure applying position and transports the original sheet along the transparent plate. The light source illuminates the transported original sheet, while the detecting device detects the reflection light. The illuminated portion of the transported original sheet is positioned at the upstream side of the pressure applying position, where the transported original sheet has a good contact with the transparent plate without floating, while the floating of the transported original sheet occurs at the downstream side of the pressure applying position. Accordingly, since only the light reflected from the portion of the original sheet having a good contact with the transparent plate is detected while the light reflected from the floating portion of the original sheet is not detected, the off-focus during the image reading operation can be avoided, and thus the quality of the image read from the transported original sheet can be effectively improved.

In the second image reading apparatus, the transporting device transports the original sheet to the transparent plate. The pressure roller of the transporting device presses the original sheet at the pressure applying position and transports the original sheet along the transparent plate. The light source illuminates the transported original sheet, while the detecting device detects the reflection light. The plate portion of the paper guide is disposed parallel to the transparent plate with the small gap therebetween in the vicinity of the pressure roller. The original sheet is transported along the transparent plate in the small gap. Accordingly, since the movement of the transported original sheet is restricted within the small gap during the image reading operation, the off-focus during the image reading operation can be avoided, and thus the quality of the image read from the transported original sheet can be effectively improved.

At the same time, the surface of the plate portion of the paper guide facing to the transparent plate consists of a reflecting surface. Accordingly, since the reflecting surface reflects the light from the light source toward the detecting device when the off-center of the original sheet occurs and the reflecting surface is exhibited as the background image with respect to the detecting device, the shadow image is effectively avoided with little or no image loss, by the second image reading apparatus.

In the third image reading apparatus, the transporting device transports the original sheet to the transparent plate. The pressure roller of the transporting device presses the original sheet at the pressure applying position and transports the original sheet along the transparent plate. The light source illuminates the transported original sheet, while the detecting device detects the reflection light. The roller portion of the pressure roller has a width smaller than a predetermined smallest width of the original sheet. The inclined portion of the pressure roller is coaxially connected to the end of the roller portion at one end thereof. This one end of the inclined portion has the same diameter as the roller portion, and the diameter of the inclined portion decreases from this one end toward the other end. Accordingly, the inclined portion does not have a contact with the transparent plate, while the roller portion presses the original sheet during its transportation. Consequently, the pressure roller does not have a contact with the transparent plate during the image reading operation in case that the original sheet of any size is transported. Thus, the original sheet can be smoothly transported with a constant speed, without a clumsy movement due to the change of the frictional force of the pressure roller, through the image reading position regardless of the size of the original sheet.

At the same time, since the diameter of the inclined portion, which has the same diameter at one end connected to the roller portion, gradually decreases from one end toward the other end, the change of the reflection light amount between the roller portion and the inclined portion is not so drastic to cause an outstanding shadow line image at the background of the original sheet. Consequently, the quality of the image read from the transported original sheet can be effectively improved.

Further objects and advantages of the present invention will be apparent from the following description of the preferred embodiment of the invention is illustrated in the accompanying drawings.

DETAILED DESCRIPTION OF THE PREFERRED EMBODIMENT

A preferred embodiment of the present invention will be described below with reference to the accompanying drawings.

Figure 1:
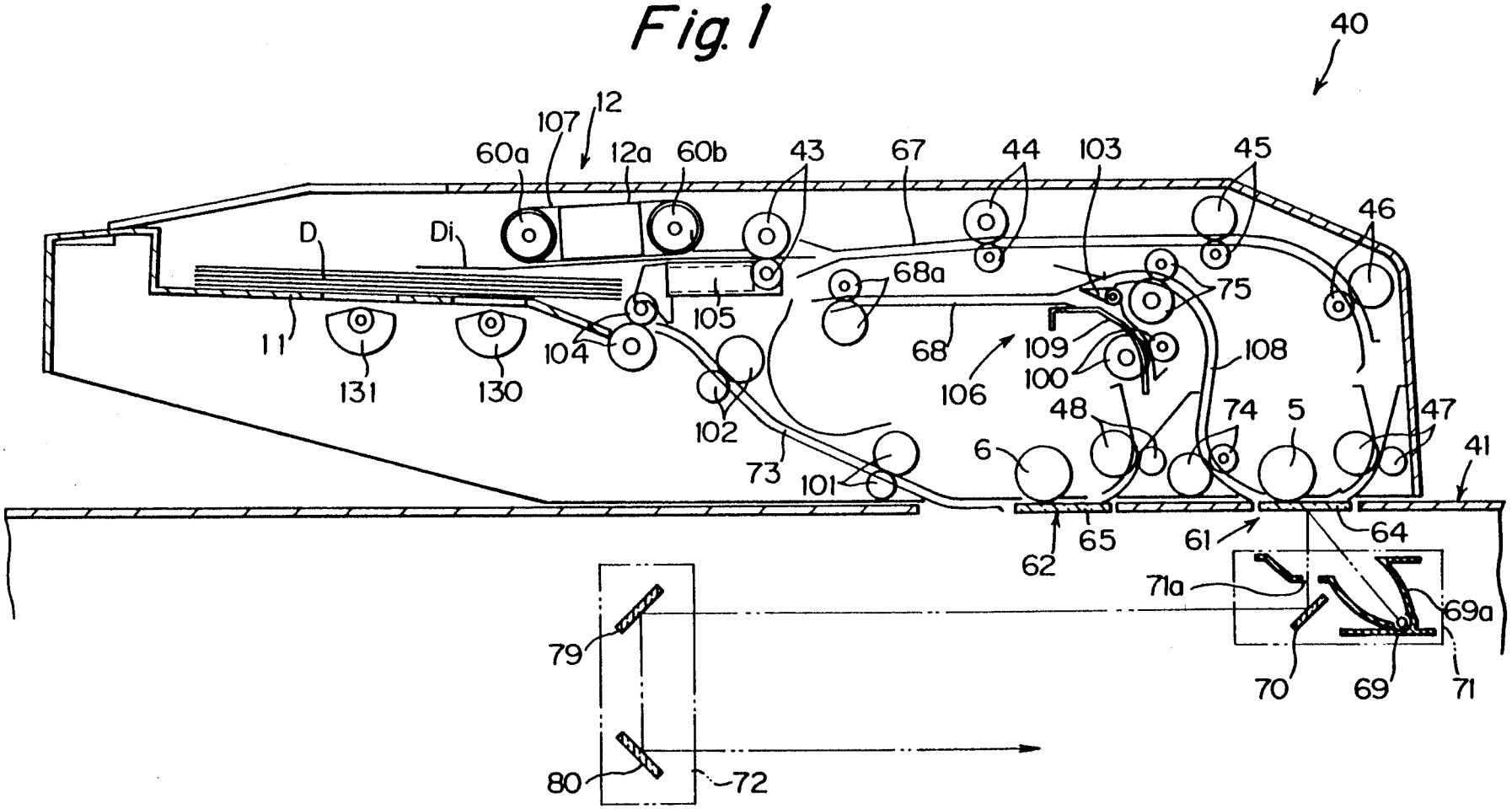
FIG. 1 is a schematic sectional view showing a construction of a transporting device in a copying apparatus of FIG. 2 as the first embodiment according to the present invention.
Figure 2:
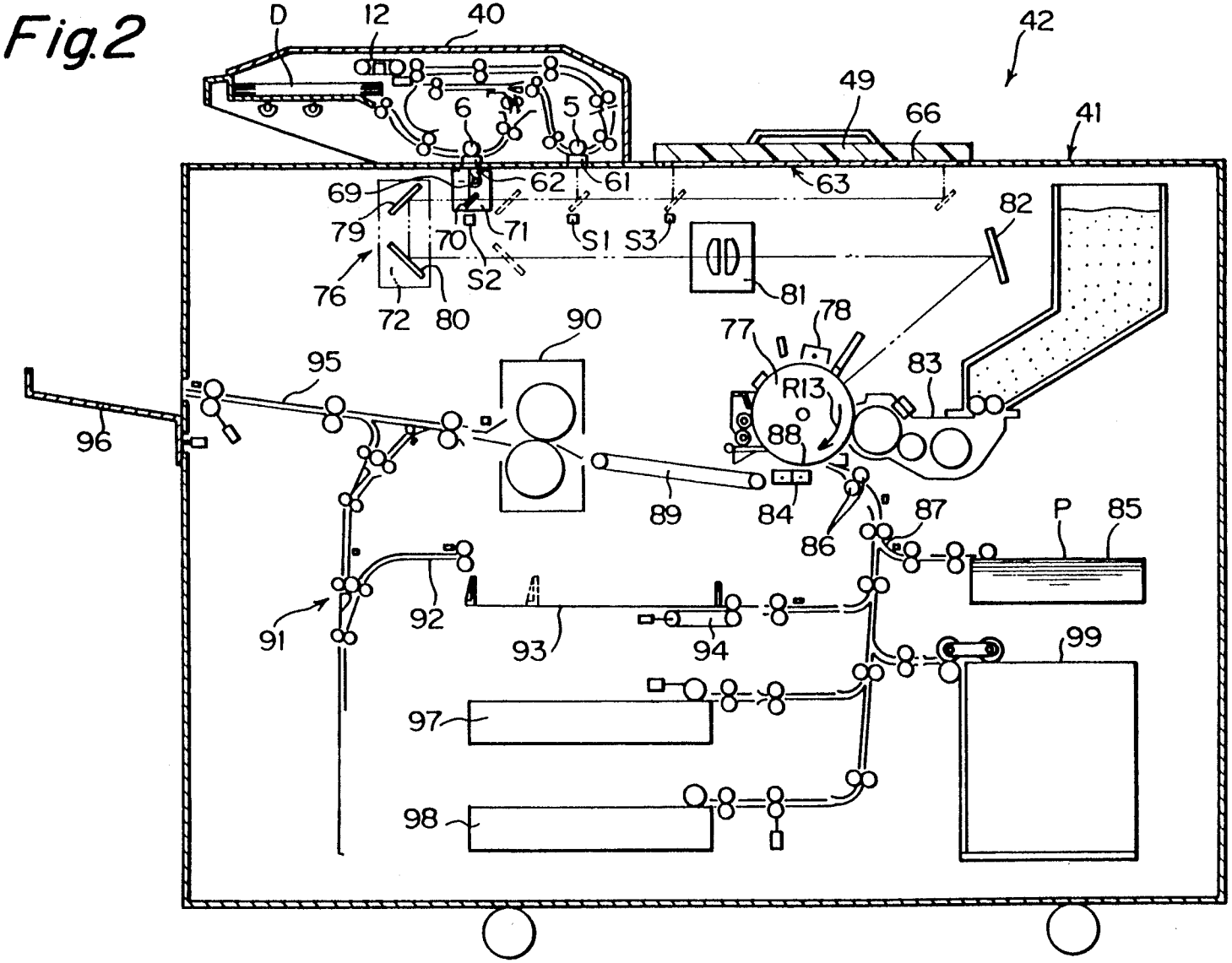
FIG. 2 is a schematic sectional view showing the construction of the copying apparatus of the first embodiment.

FIG. 1 shows a device for transporting an original sheet of a copying apparatus as a first embodiment according to the present invention, while FIG. 2 shows the whole configuration of the copying apparatus of FIG. 1.

In FIGS. 1 and 2, the reference numeral 40 designates a transporting device for transporting an original sheet Di, provided on a main body 41 of a copying apparatus 42.

In FIG. 2, the transporting device 40 and the pressure applying plate 49 are disposed on the main body 41.

In FIG. 1, a first transparent plate 64 and a second transparent plate 65 provided on the upper surface of the main body 41 construct a first image reading position 61 and a second image reading position 62 respectively.

In FIG. 2, a third transparent plate 66 is formed as an original sheet placing table at the pressure applied face of the main body 41 with respect to the pressure applying plate 49. The third transparent plate 66 contstructs a third image reading position 63. An image of a binded book etc. is placed and exposed at this third image reading position 63.

In FIG. 1, a plurality of sheets D of a same sized sheet form, stacked in an order of their page number for example, are accommodated in a hopper 11 of the transporting device 40 in such a manner that the front surface of the sheet D of page 1 faces downward. The sheet D also has an image on its rear surface.

A blowing duct 105 is disposed at the right side of the hopper 11. The blowing duct 105 sends air to the right edge face of the stacked sheets D so as to separate the sheets D at the right edge face. The sheet Di at this condition is supplied to a transporting path 67 by a sheet supplying device 12 and a transporting roller 43, from the top to the bottom one by one.

A sheet supplying device 12 is disposed above the right portion of the sheet D. The sheet supplying device 12 includes rollers 60*a*, 60*b*, an endless belt 107 which is wound on these rollers 60*a*, 60*b*, and a duct 12*a* disposed inside of the belt 107 and opening toward the sheet D. The belt 107 has a plurality of apertures widely distributed over the surface thereof. An evacuation device (not shown) is communicated with the duct 12*a* for evacuating the air adjacent to the sheet Di through the belt 107 in cooperation with the blowing duct 105.

Accordingly, the sheet supplying device 12 can supply the sheet Di to the transporting path 67 by absorbing and holding the sheet Di on the outernal surface of the belt 107 and by rotating the rollers 60*a*, 60*b*.

The blowing duct 105 is, for example, communicated with an induction fan (not shown) and blows the air toward the edge face of the stacked sheets D at the downstream side with respect to the transporting direction, and separates the sheets D at that side so as to prevent an undesirable duplicated transportation of the sheet D.

The transporting path 67 includes one pair of guiding members and a plurality of pairs of rollers 44,45,46 disposed along the transporting direction, and transports the sheet Di to the space between a pressure roller 5 and the transparent plate 64.

A pair of first resist rollers 47 is equipped at the exit of the transporting path 67 on the side of transparent plate 64. A driving force transmitting device is connected to the rotating shaft of the resist rollers 47 via a clutch CLT1 (not shown) as described later.

The transportation timing of the sheet Di to the transparent plate 64 is controlled by the rotating and stopping control of these rollers 47 by means of the connecting and disconnecting control of the clutch CLT1.

The sheet Di smoothly entering the area of the upper surface of the transparent plate 64 from the upper side off to the right of the transparent plate 64 is transported by the pressure roller 5 which presses the sheet Di onto the transparent plate 64. Then, the original image on the rear surface (which has faced upward in the hopper 11) of the sheet Di, is exhibited to the transparent plate 64 at the first image reading position 61, when the slit-exposure process is performed as described later in detail. Then, the sheet Di past the pressure roller 5, is transported, as separating smoothly from the transparent plate 64, toward the upper side off to the left of the transparent plate 64 by a transporting path 108. The transporting path 108 includes a pair of guiding members and pairs of roller 74,75 disposed along the transporting path 108.

Then, the sheet Di is reversed in its transporting direction by a reversing device 106.

In the reversing device 106, the sheet Di from the first image reading position 61 is introduced from the transporting path 108 to a transporting path 68 through a switching nail 103. In the transporting path 68, a reversing roller 68*a* is provided which can rotate selectively forward and backward. The sheet Di introduced to the transporting path 68 is transported to a transporting path 109 by reversing the rotating direction of the roller 68*a* and the switching operation of the switching nail 103.

The sheet Di guided to the transporting path 109 is then transported to a second resist roller 48 by a pair of transporting rollers 100.

A driving force transmitting device (not shown) is connected to the rotating shaft of the second resist rollers 48 via a clutch CLT2 (not shown) as described later.

The transportation timing of the sheet Di to the transparent plate 65 is controlled by the rotating and stopping control of these rollers 48 by means of the connecting and disconnecting control of the clutch CLT2.

The sheet Di past the roller 48 enters smoothly the area of the upper surface of the transparent plate 65 from the upper side off to the right of the transparent plate 65, and is transported while being pressed onto the transparent plate 65 by a pressure roller 6. Since the sheet Di is reversed in its transportation direction and its surface by the reversing device 106, the original image on the front surface (which has faced downward in the hopper 11) of the sheet Di, is exhibited to the transparent plate 65 at the second image reading position 62, and the slit-exposure process is performed as described later in detail.

Then the sheet Di past the pressure roller 6, is transported, as separating smoothly from the transparent plate 65, toward the upper side off to the left of the transparent plate 65 by a transporting path 73. The transporting path 73 includes a pair of guiding members and pairs of rollers 101,102 disposed along the transporting path 73.

The sheet Di guided by the transporting path 73 is then transported by transporting rollers 104, semicircular rollers 130,131 disposed in the vicinity of the hopper 11, and accommodated back into the lowest portion of the sheets D stacked in the hopper 11.

As described above, the transporting device 40 can transport the sheet Di one by one to the first image reading position 61 with the rear surface of the sheet Di facing the transparent plate 64 and to the second image reading position 62 with the front surface of the sheet Di facing the transparent plate 65.

In FIG. 2, an exposing device 76, a photo-sensitive drum 77 and a corona-discharging device 78 for charging the surface of the photo-sensitive drum 77, are provided within the main body 41.

The exposing device 76 performs the slit-exposure process by illuminating the exhibited portion of the original image through each transparent plate 64,65,66, collecting the reflection light from the illuminated portion through each transparent plate 64,65,66 and through a slit 71*a*, and transmitting the collected slitted light onto the photo-sensitive drum 77 so as to make a latent image thereon corresponding to the original image on the sheet Di.

The photo-sensitive drum 77 has a horizontal rotational axis and is rotated in a direction indicated by an arrow R13. The latent image corresponding to the illuminated portion of the original image is formed on the photo-sensitive drum 77 by the slit-exposure of the transmitted slitted light.

The exposing device 76 has a first moving body 71 which is equipped with a light source 69 and reflection mirrors 69*a*, 70 as shown in FIGS. 1 and 2. The first moving body 71 is adapted to move to the positions opposing to each image reading position 61,62,63.

When the rear surface of the sheet Di is to be copied, the first moving body 71 is moved and positioned to the position right under the first image reading position 61.

When, the front surface of the sheet Di is to be copied, the first moving body 71 is moved and positioned to the position right under the second image reading position 62.

In case of copying an original image in a binded book placed on the transparent plate 66, the first moving body 71 is moved horizontally under the transparent plate 66 so as to scan all the surface of the original image facing the transparent plate 66.

The first moving body 71 has the slit 71*a*, such that the reflection light from the illuminated original image is slitted and the resultant slitted light is directed to the mirror 70 and is reflected into a horizontal direction to the left.

The exposing device 76 also has a second moving body 72 which is equipped with reflection mirrors 79,80. The second moving body 72 is adapted to move in the same direction as that of the first moving body 71 at a half (½) speed of that of the first moving body 71.

The slitted light from the first moving body 71 is reflected by the mirrors 79 and 80 into a horizontal direction to the right.

The slitted light from the second moving body 72 is then transmitted through a zooming lens 81 and reflected by a reflection mirror 82 toward the photo-sensitive drum 77, where the slitted light is focused to form the image corresponding to the illuminated original image.

In case of copying the original image at each image reading position 61,62, the photo-sensitive drum 77 is rotated in accordance with the rotation of the pressure roller 5,6, i.e. the movement of the original sheet Di along the transparent plate 5,6 so that the latent image corresponding to the slitted light is continuously formed thereon to resultantly form whole original image of the sheet Di.

In case of copying the original image at the third image reading position 63, the photo-sensitive drum 77 is rotated in accordance with the movement of the first moving body 71, so that the latent image is continuously formed thereon to resultantly form whole original image.

As described above, each exhibited original image at each image reading position 61,62,63 can be optically read by the exposing device 76.

Figure 3:
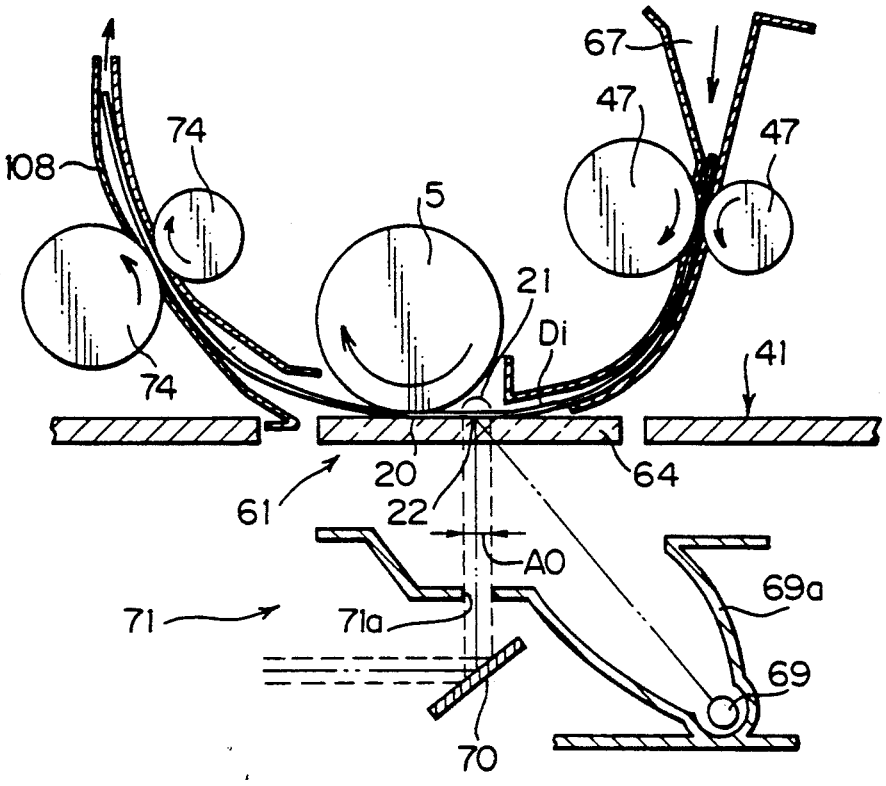
FIG. 3 is a schematic sectional view showing the construction of the pressure roller and the transparent plate of FIG. 1.

FIG. 3 shows the first moving body 71 in case of image-reading the original sheet Di at the first image reading position 61, and the structure of the device 40 around the pressure roller 5.

In FIG. 3, the reference numeral 20 designates a pressure applying position of the pressure roller 5, where the pressure is applied to the sheet Di on the transparent plate 64. The reference numeral 21 designates a slit-exposure position of the sheet Di, which is the most strongly illuminated portion of the sheet Di by the light source 69 and the mirror 69*a* which concentrates the light from the light source 69. The light source 69 may consist of a harogen lamp of bar-like shape.

The slit-exposure position 21 is opposed to the slit 71*a* such that the reflection light from the slit-exposure position 21 becomes the slitted light. The reference numeral 22 designates a center point of the slit-exposure position 21.

Figure 4:
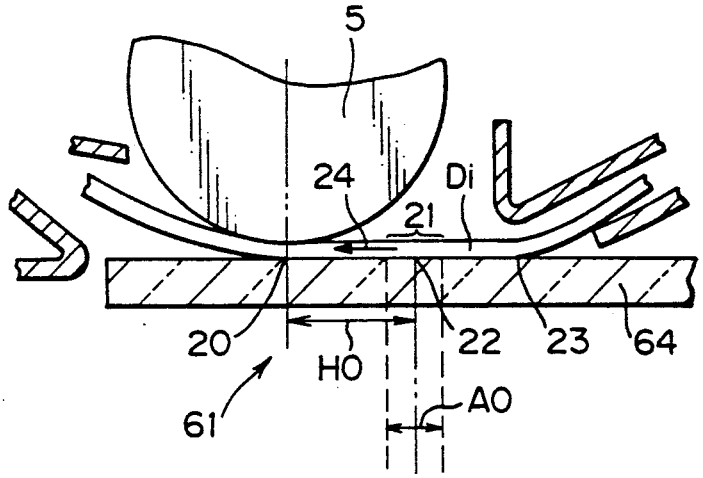
FIG. 4 is a schematic sectional view showing the shape of the transported original sheet of FIG. 3.

In the present embodiment, the slit exposure position 21 is set at the upstream side of the pressure applying position 20 with respect to the transporting direction 24, as shown in FIG. 4, of the sheet Di.

FIG. 4 shows those positional relationships and the form of the transported sheet Di around the transparent plate 64.

In FIGS. 3 and 4, the sheet Di entering the area of the transparent plate 64 from the upper side off to the right of the pressure roller 5 through the path 67 as aforementioned, is transported by the pressure roller 5 along the transparent plate 64 while being pressed onto the transparent plate 64, and then transported toward the path 108. The reference numeral 23 designates a position of the sheet Di where the sheet Di starts to have a contact with the transparent plate 64.

As shown in FIG. 4, because of the stiffness and elasticity of the sheet Di, as the sheet Di is transported to the path 108 extending obliquely and upwardly in a curved shape, the sheet Di gradually separates from the surface of the transparent plate 64 after passing through the pressure applying position 20.

Accordingly, at the downstream side of the pressure applying position 20, the sheet Di does not have a good contact with the transparent plate 64, i.e. the floating of the sheet Di occurs.

At the upstream side of the pressure roller 5, the sheet Di presses itself onto the transparent plate 64 by its rigidity and elasticity in the vicinity of the pressure roller 5.

This is because, since the sheet Di is pushed from the behind until the tip of the sheet Di reaches the pressure roller 5 on the initial introduction to the pressure roller 5, such a condition is achieved that the portion of the sheet Di near the tip is pressed onto the transparent plate 64 so as to get a good contact with the transparent plate 64, and because this once achieved condition is maintained after the pressure roller 5 starts transporting the sheet Di, since the distance between the pressure roller 5 and the roller 47 is unchanged.

Accordingly, the region of the transporting path of the sheet Di where the sheet Di has a good contact with the transparent plate 64, is from the position 23, which is determined in advance by the design of the transporting path 67 and the material of the sheet Di, to the pressure applying position 20.

Consequently, in the present embodiment, the slit-exposure position 21 is set such that the center point 22 is apart fom the pressure applying position 20 toward the upstream side by a predetermined distance $H_0$, and such that the slit-exposure position 21 having a width $A_0$ is within the above mentioned region between the position 23 and the pressure applying position 20.

As described above, since the slit-exposure process is performed by utilizing the non-floating portion of the sheet Di at the slit-exposure position 21, such an off-focus as in the case of the aforementioned related art device does not occur in the present embodiment, thus the original image can be read by the copying apparatus with a high quality.

As a result, the recording sheet, on which the read original image is copied, is free from the degration due to the off-focus in the image reading process, and thus a high quality is maintained in the output of the copying apparatus.

The construction as for the second image reading position 62 is in same manner as the above described construction as for the first image reading position 61, so the explanation as for the second image reading position 62 is omitted.

The image formation onto the recording sheet will be explained hereinbelow.

In FIG. 2, the latent image formed on the photo-sensitive drum 77 is developped by the developping device 83, and the toner image is formed on the photo-sensitive drum 77. Then, the corona-discharging device 84 transfers the toner image onto one surface of a recording sheet P.

The sheet P is contained in the sheet supplying cassette 85 in advance, transported by the transporting device 87 including a pair of third resist rollers 86, and introduced to the image transfer region 88.

To the rotating shaft of the third resist rollers 86 is connected a driving force transmitting device (not shown) via a clutch CLT3 (not shown) as described later.

By controlling the connecting and disconnecting operation of this clutch CLT3 in cooperation with the control of the aforementioned clutches CLT1 and CLT2, the transportation timing of the sheet P by the rollers 86 can be properly adjusted with the toner image on the photo-sensitive drum 77.

The sheet P, on which the toner image is transferred, is then introduced to the fixing device 90 through a transporting device 89, and undergoes the fixing process.

The sheet P after the fixing process is reversed in its transporting direction by a direction changing device 91, and then accommodated temporarily through a transporting path 92 into an intermediate accommodating device 93.

The sheet P in the accommodating device 93 is introduced again to the image transfer region 88 by a transporting device 94 and the rollers 86, where another toner image is transferred to the other surface of the sheet P.

When the image transferring operation is finished, the sheet P is discharged through the transporting device 89, the fixing device 90 and a transporting path 95 onto a tray 96 disposed outside of the main body 41.

In the aboove described manner, the original images on both surfaces of the sheet Di are copied onto the both surfaces of the corresponding sheet P respectively.

Sheet supplying cassettes 85, 97, 98, 99 selectively supply, to the image transfer region 88, recording sheets P of sizes different from each other.

The electrical circuit of the copying appararus 42 will be explained hereinbelow.

Figure 5:
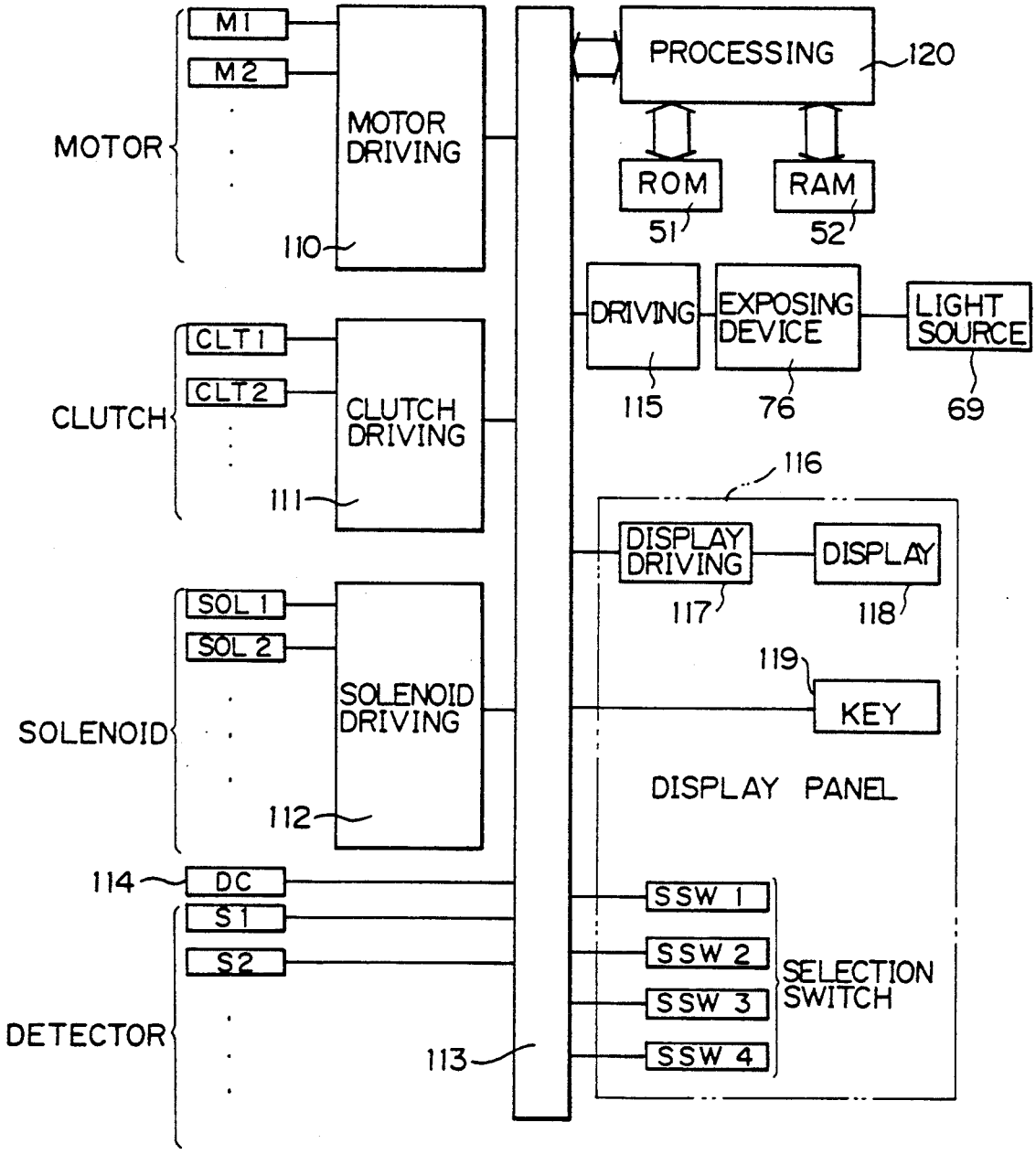
FIG. 5 is a block diagram showing the electrical construction of the copying apparatus of FIG. 2.

In FIG. 5, the electrical circuit includes a motor driving circuit 110, a clutch driving circuit 111, and a solenoid driving circuit 112.

A plurality of motors M1, M2, . . . for driving a plurality of rollers such as the pressure rollers 5, 6, . . . are connected to the motor driving circuit 110.

The clutches CLT1, CLT2, . . . which are disposed between the rollers and the motors, and control the driving timings thereof with purpose of synchronizing the transporting timings of the sheet Di and the sheet P, etc., are conected to the clutch driving circuit 111.

A plurality of solenoids SOL1, SOL2, . . . of electro magnetic type, for operating the switching nail 103 etc., are connected to the solenoid driving circuit 112.

Those driving circuits 110, 111, 112 are connected to an interface circuit 113.

To the interface circuit 113 are connected a DC power supply 114, various kinds of detector S1, S2, . . . , which are also shown in FIG. 2, for detecting conditions of the transportation of the sheet Di and the sheet P, a driving circuit 115 for driving the exposing device 76, input keys 119 on a control panel 116 provided on the main body 41, a display driving circuit 117 for driving a display device 118 on the control panel 116 and so on.

The interface circuit 113 is also connected to a processing circuit 120 which may consist of a microcomputer. The interface circuit 113 transmits detection signals from the detectors S1, S2, . . . to the processing circuit 120, and transmits control signals from the processing circuit 120 to the circuits 110 to 117.

A ROM (Read Only Memory) 51 and a RAM (Random Access Memory) 52 are connected to the processing circuit 120.

The processing circuit 120 controls the copying operation of the copying apparatus 42, i.e. the transporting operation of the transporting device 40 and the exposing operation of the exposing device 76 etc. in a prescribed harmonized manner, according to the control program stored in the ROM 51 in advance.

The RAM 52 is used as the working and calculating area of the processing circuit 120, for such operations as counter, timer, flag operations and so on needed for the copying operation.

The interface circuit 113 transmits the control signal, from the processing circuit 120 to the driving circuit 115, for driving the exposing device 76 so as to controls the ON/OFF operation and the intensity level of the light source 69 at each image reading position 61, 62, 63.

The interface circuit 113 also transmits the signals inputted by the key 119 to the processing circuit 120, and transmits, the control signal and the information as for the condition of the progres in the copying operation, to the display driving circuit 117 so as to drive the display device 118 to display the information thereon.

To the interface circuit 113 are also connected a plurality of selection switches SSW1 to SSW4 for selecting the copying mode of the copying apparatus 42 by use of the transporting device 40. By operating those switches SSW1 to SSW4, one mode can be selected, as a mode of performing a set of copy operations with a set of sheets D, out of various modes i.e. a mode of one side copy operation from one side original, a mode of both side copy operation from one side original, a mode of one side copy operation from both side original, and a mode of both side copy operation from both side original.

As described above, according to the first embodiment, since the slit-exposure position 21 is set at the upstream side of the pressure applying position 20 with respect to the transporting direction of the sheet Di, the off-focus due to the floating of the sheet Di is prevented in the slit-exposure process, and thus the quality of the copied image on the outputted recording sheet P can be greatly improved.

Figure 6:
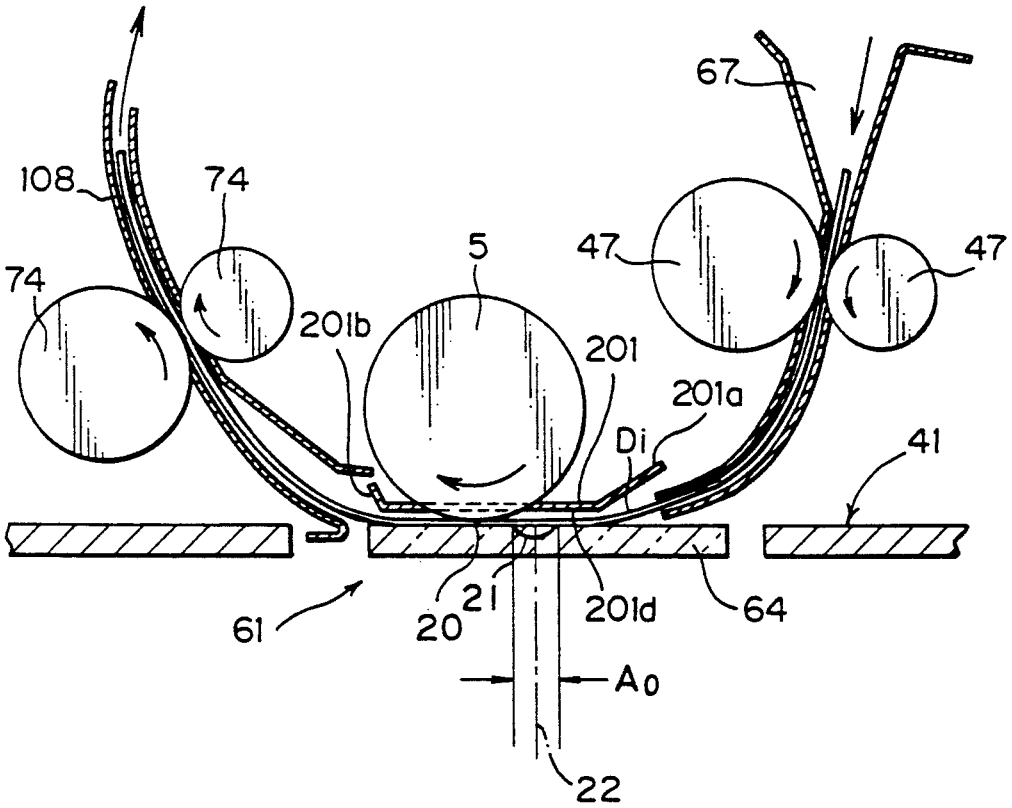
FIG. 6 is a schematic sectional view showing the construction of the pressure roller, the transparent plate and the paper guide of the second embodiment according to the present invention.

FIG. 6 shows a portion around a pressure roller of a transporting device of a second embodiment according to the present invention, which is in place of the transporting device 40 of the first embodiment. In FIG. 6, the same elements as those in FIG. 3 carry the same reference numerals and the explanations thereof are omitted.

In FIG. 6, the only difference between the transporting device 40 of the first embodiment and the transporting device of the second embodiment is that, there is provided a paper guide 201 in the vicinity of the pressure roller 5 in the second embodiment.

Figure 7:
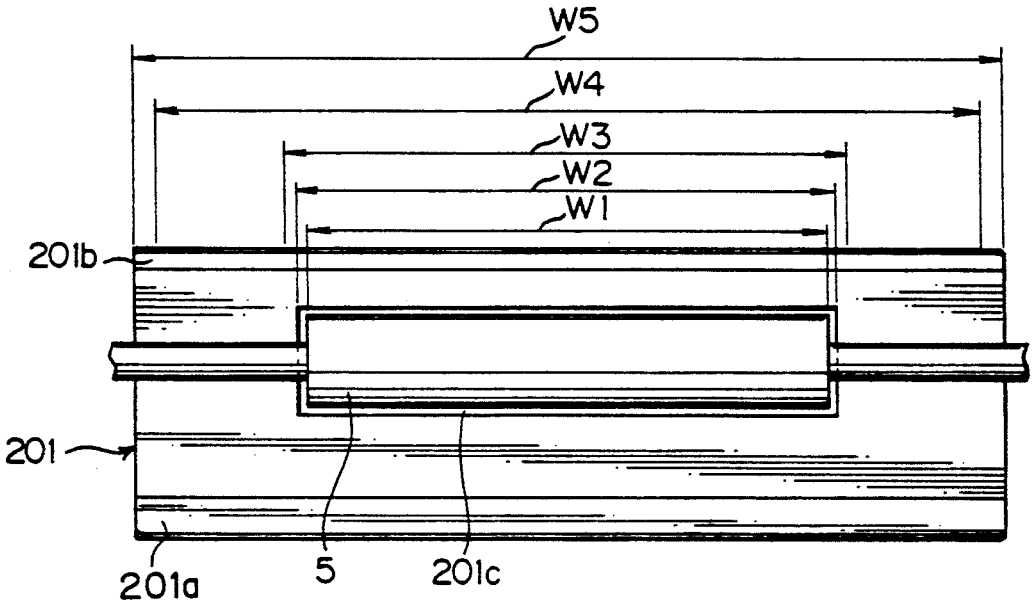
FIG. 7 is a schematic plan view showing the construction of the paper guide of FIG. 6.

As shown in FIG. 7, the paper guide 201 has a rectangular plate like shape. The paper guide 201 is disposed to face the transparent plate 64 with such a small gap therebetween that the sheet Di can be introduced therebetween but the vertical movement of the sheet Di is restricted therebetween.

As shown in FIGS. 6 and 7, the upstream edge portion 201*a* and the downstream edge portion 201*b* are bent upwardly and obliquely so that the sheet Di can be introduced below the paper guide 201 smoothly.

The paper guide 201 has a rectangular opening portion 201*c* at its central portion, through which the pressure roller 5 can press the sheet Di onto the transparent plate 64. Thus, the paper guide 201 is disposed such that the paper guide 201 surrounds the portion of the sheet Di at the pressure applying position 20.

Since the paper guide 201 thus constructed is provided, even if the sheet Di has a strong stiffness, the floating of the sheet Di is effectively prevented at the slit-exposure position 21 since the paper guide 201 holds the sheet Di within the prescribed gap between the paper guide 201 and the transparent plate 64. Thus, the degration of the read image due to the off-focus in the slit-exposure process is prevented in the second embodiment.

The lower face 201*d* of the paper guide 201, which faces the transparent plate 64, consists of a white reflecting surface for reflecting the light from the light source through the transparent plate 64.

The width $W_1$ of the pressure roller 5 is smaller than the prescribed smallest original sheet width $W_3$. The width $W_2$ of the portion 201*c* is larger than the width $W_1$ and smaller than the width $W_3$. The width $W_5$ of the paper guide 201 is larger than the prescribed largest original sheet width $W_4$ as shown in FIG. 7.

Accordingly, not only when the discrepancy between the sheet Di and the sheet P, that is, when the off-center occures, but also when the sheet P is larger than the sheet Di, the shadow image in the edge portion of the sheet P is prevented by the effect of the reflecting surface of the paper guide 201, and the image loss is effectively avoided in the second embodiment.

The above explained construction of the paper guide 201 at the first image reading position 61 can be also adapted in the same manner to the second image reading position 62 of the first embodiment. Thus, both side copy operation can be performed with the benefit of the second embodiment.

In the second embodiment, though the shape of the paper guide 201 is rectanglar with the opening portion 201*c* in the central portion thereof, this however may be constructed in other shape.

Figure 8:
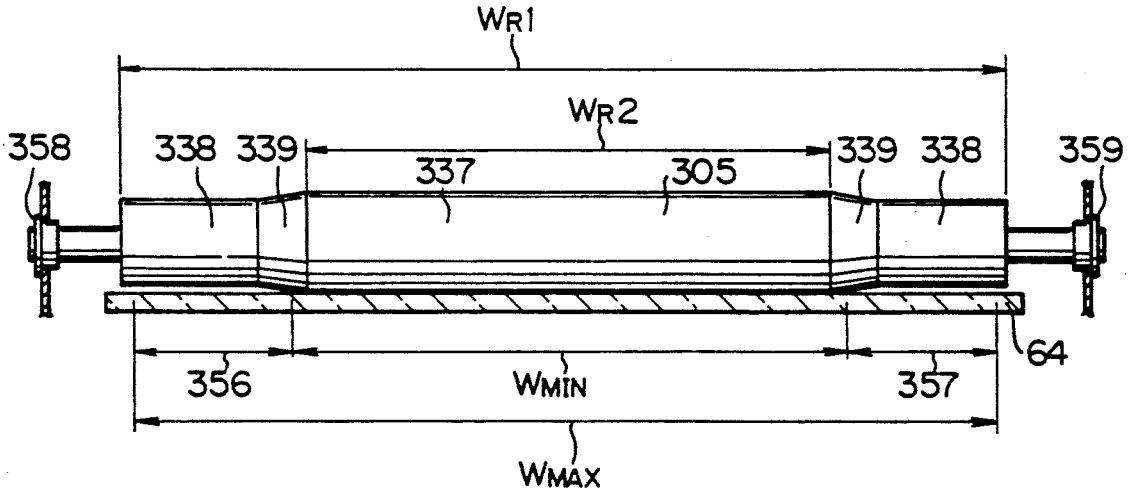
FIG. 8 is a schematic front elevational view showing the construction of the pressure roller of the third embodiment according to the present invention.

FIG. 8 shows a pressure roller of a transporting device of a third embodiment according to the present invention, which is disposed in place of the pressure roller 5 of the first embodiment. In the third embodiment, the explanation of the same elements as those in the first embodiment are omitted.

In FIG. 8, a pressure roller 305 is rotatably mounted to the main body of the transporting device by bearings 358,359.

The pressure roller 305 has a larger diameter portion 337 having the width $W_{R2}$ at a central portion thereof with respect to the axial direction thereof, and each smaller diameter portion 338 at each end portion thereof. The portion 337 has the function of pressing and transporting the sheet Di. The portion 337 is located within the region of the prescribed smallest original sheet width $W_{MIN}$ of the transported sheet Di. The whole width $W_{R1}$ of the pressure roller 305 is set to be larger than the prescribed largest original sheet width $W_{MAX}$ of the sheet Di to be transported.

The pressure roller 305 also has each inclined portion 339 of a cone shape between the portion 337 and each portion 338, which diameter is gradually changed from the diameter of the portion 337 to the diameter of the 338.

The outer circumferential surface of the pressure roller 305 is colored with such a white type color as to be able to effectively reflect the light from the light source through the transparent plate 64.

As the material of the pressure roller 305, a material is preferably selected, which has a relatively high friction coefficient against the sheet Di so that the sheet Di is not slipped but is transported with a good contact to the transparent plate 64, which color belongs to the white type color so as to reflect the illuminated light thereon, and in which the temperature increase caused by the illumination of the light is relatively small. For example, room temperature vulcanizing (RTV) silicon rubber is selected as such a material.

Accordingly, because of the shape of the pressure roller 305, the pressure roller 305 does not have a contact with the transparent plate 64 regardless of the size of the sheet Di while the sheet Di is transported through the first image reading position 61. Thus, there does not generated too much frictional force at the pressure roller 305, making it easy to keep the torque given to the pressure roller 305 constant and relatively small, compared with the case that the pressure roller 305 contacts with the transparent plate 64.

Thus, the irregularity of the rotation of the pressure roller 305 is restricted to a quite low level, so that the transportation speed of the sheet Di through the pressure roller 305 i.e. through the first image reading position 61 is kept to be constant during the slit-exposure process. Consequently, the image reading operation by the slit-exposure process can be performed without shrinkage or extention of the read image along the transportion direction, resulting in a high quality copied image on the outputted recording sheet P.

On the other hand, because of the reflecting property of the pressure roller 305 and the gradually inclined shape of the portion 339 between the portions 337 and 338, even if the pressure roller 305 is illuminated by the light from the light source in case of transporting a small original sheet, the pressure roller 305 itself is not copied, or the portion 339 is not copied as the shadow image in the background image of the outputted recording sheet.

Namely, for example, in case of copying an original sheet having the width $W_{MIN}$ onto a recording sheet having the width $W_{MAX}$, not only the area of the original surface but also the areas 356 and 357 at both axial end portions of the pressure roller 305 in FIG. 8 are exposed.

At this time however, because the outernal diameter of the pressure roller 305 changes gradually and continuously from the portion 337 through the portion 339 to the portion 338, the shadow image of the pressure roller 305 due to the differences between the reflecting light amounts of the portions 337,338,339, is prevented to drastically appear in the background image of the copied image at the areas 356,357, or at the upstream or downstream side of the pressure roller 305.

In the above described embodiment, the transportation of the sheet Di is performed such that the central line in the wide direction of the transported sheet Di is positioned on the central line in the axial direction of the pressure roller 305. This, however, may be performed such that one edge in the wide direction of the sheet Di is positioned on one edge in the axial direction of the pressure roller 305, which brings the advantage that only one set of the inclined portion 339 and the small diameter portion 338 is required to be formed at the other edge of the roller 305.

In the third embodiment, the shape of the portion 339 is formed in a cone shape, this however may be formed in a cone-like shape with a circumference consisting of a plurality of small stairs gradually changing in their diameter so long as the changes of the diameter can not be practically recognized as shadow line image by the copying apparatus.

The above explained construction of the pressure roller 305 at the first image reading position 61 can be also adapted in the same manner to the second image reading position 62 of the first or second embodiment. Thus, both side copy operation can be performed with the benefit of the third embodiment.

In the above described first, second and third embodiments, though the transporting device 40 is adapted in the copying apparatus 42 of a slit-exposure and latent image forming/transferring type, the transporting device 40 may be adapted in other types of the copying apparatuses or image reading apparatuses, for example such a contact type image reading apparatus utilizing a line image sensor including a photo-electric converting element such as CCD (Charge Coupled Device).

Many widely different embodiments of the present invention may be constructed without departing from the spirit and scope of the present invention. It should be understood that the present invention is not limited to the specific embodiments described in this specification, except as defined in the appended claims.

What is claimed is:

1. An original image transporting and reading apparatus comprising:

a transparent plate horizontally disposed on which an original image reading operation is performed;

a transporting means disposed above said transparent plate for transporting an original sheet having an original image to said transparent plate, including a pressure roller for pressing said original sheet onto an upper surface of said transparent plate at a pressure applying position and transporting said original sheet along said upper surface of said transparent plate, and a transporting path disposed on an upstream side and a downstream side of said pressure applying position with respect to a transporting direction of said original sheet and extending obliquely and upwardly in a curved shape with respect to said transparent plate for obliquely transporting said original sheet to and from said pressure applying position therethrough;

a light source disposed below said transparent plate for illuminating through said transparent plate a portion of said transported original sheet, said illuminated portion being positioned on said upper surface of said transparent plate adjacent to said pressure applying position at said upstream side; and an image reading means disposed below said transparent plate for receiving through said transparent plate a reflection light from said illuminated portion of said original sheet so as to read an image on said transported original sheet.

2. An original image transporting and reading apparatus according to claim 1, wherein said image reading means includes a slit and receives said reflection light through said slit so as to perform a slit exposure operation.

3. An original image transporting and reading apparatus according to claim 1, wherein said transporting means is provided with a hopper from which said original sheet is transported to said transporting path and to which said original sheet is transported back from said transporting path.

4. An original image transporting and reading apparatus according to claim 1, further comprising a paper guide having a plate portion which is disposed parallel to said transparent plate with a small gap therebetween in the vicinity of said pressure roller, a surface of said paper guide facing the upper surface of said transparent plate comprising a reflecting surface, said original sheet being transported along said transparent plate in said small gap.

5. An original transporting and reading apparatus according to claim 4, wherein said image reading means includes a slit and receives said reflecting light through said slit so as to perform a slit-exposure operation.

6. An original image transporting and reading apparatus comprising:

a transparent plate horizontally disposed on which an original image reading operation is performed:

a transporting means disposed above said transparent plate for transporting an original sheet having an original image to said transparent plate, including a pressure roller for pressing said original sheet onto an upper surface of said transparent plate at a pressure applying position and transporting said original sheet along said upper surface of said transparent plate;

a light source disposed below said transparent plate for illuminating through said transparent plate a portion of said transported original sheet on said transparent plate; and an image reading means disposed below said transparent plate for receiving through said transparent plate a reflection light from said illuminated portion of said original sheet so as to read an image on said transported original sheet, said pressure roller comprising a roller portion, which presses said original sheet and which has a width smaller than a predetermined smallest width of said original sheet, and at least one inclined portion, one end of which is coaxially connected to an end of said roller portion and has a diameter the same as said roller portion and which diameter gradually decreases from said one end toward the other end of said inclined portion.

7. An original image transporting and reading apparatus according to claim 6, wherein said roller portion occupies a central portion of said pressure roller, and said peressure roller includes two of said inclined portions, each being connected to an end of said roller portion.

8. An original image transporting and reading apparatus according to claim 6, wherein said pressure roller further comprises a cylindrical portion one end of which is coaxially connected to the other end of said inclined portion, said cylindrical portion having the same diameter as the other end of said inclined portion.

9. An original image transporting and reading apparatus according to claim 6, wherein said pressure roller has a white surface for reflecting a light from said light source through said transparent plate.

10. An original image transporting and reading apparatus according to claim 6, wherein said image reading means includes a slit and receives said reflection light through said slit so as to perform a slit-exposure operation.

* * * * *